United States Patent [19]

Gibbs

[11] Patent Number: 4,636,755

[45] Date of Patent: Jan. 13, 1987

[54] HIGH-RATIO, ISOLATED MICROWAVE BRANCH COUPLER WITH POWER DIVIDER, PHASE SHIFTERS, AND QUADRATURE HYBRID

[75] Inventor: Terry L. Gibbs, Tempe, Ariz.

[73] Assignee: Motorola, Inc., Schaumburg, Ill.

[21] Appl. No.: 634,855

[22] Filed: Jul. 26, 1984

[51] Int. Cl.[4] ..... H01P 5/12

[52] U.S. Cl. ..... 333/116; 333/120; 333/128; 333/161

[58] Field of Search ..... 333/116, 117, 115, 109, 333/120, 121, 123, 125, 127, 128, 136, 161, 164, 246; 343/700 MS File

[56] References Cited

U.S. PATENT DOCUMENTS

| | | | |
|---|---|---|---|
| 3,164,791 | 1/1965 | Dent | 333/123 |
| 3,691,485 | 9/1972 | Beck | 333/123 |
| 3,769,610 | 10/1973 | Savarin et al. | 333/111 |
| 3,895,321 | 7/1975 | Seidel | 333/109 |
| 3,990,078 | 11/1976 | Bellee et al. | 343/770 |
| 4,263,598 | 4/1981 | Bellee et al. | 343/700 MS File |
| 4,305,043 | 12/1981 | Ho et al. | 333/116 X |
| 4,431,997 | 2/1984 | Sasser et al. | 343/770 |

OTHER PUBLICATIONS

Bailey, M. C., "A Simple Stripline Design for Uneven Power Split", *NASA Technical Memo* 81870; Langley Research Center, Hampton, Va.; Aug. 1980.

*Primary Examiner*—Eugene R. LaRoche
*Assistant Examiner*—Benny T. Lee
*Attorney, Agent, or Firm*—Lowell W. Gresham

[57] ABSTRACT

A microwave coupler which receives an input signal and converts it into two output signals is dislosed wherein the output signals exhibit the same phasing, the output signals are isolated, and a predetermined ratio exists between the power level of one output signal and the power level of the other output signal. An equal-split power divider transforms the input signal into intermediate signals which are then isolated and phase shifted. A quadrature hybrid combines the phase shifted signals and produces the output signals.

7 Claims, 4 Drawing Figures

FIG. 3
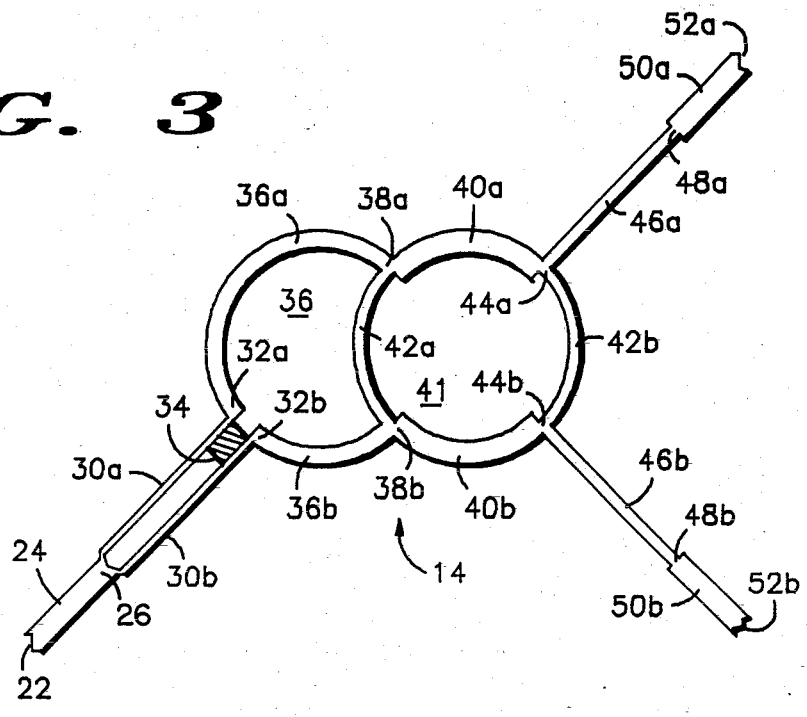
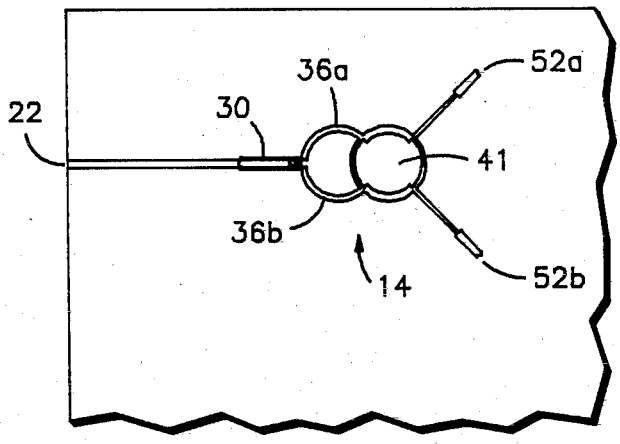
FIG. 4

HIGH-RATIO, ISOLATED MICROWAVE BRANCH COUPLER WITH POWER DIVIDER, PHASE SHIFTERS, AND QUADRATURE HYBRID

BACKGROUND OF THE INVENTION

The present invention relates generally to microwave couplers which convert one input signal into two output signals. Specifically, the present invention relates to a coupler which produces two isolated output signals in-phase with each other at typically unequal power levels. Furthermore, the present invention permits power division at a ratio of at least 13 dB between the outputs while using common manufacturing tolerances and requiring only a small amount of space.

Various image element and other multi-element antenna systems known in the art may advantageously use the present invention. These antenna systems incorporate a multiplicity of antenna elements arranged in a specific configuration to achieve a desired radiation pattern. One feed signal typically energizes the entire antenna system through a feed network which divides the feed signal into a multiplicity of sub-signals at various phase and power level relationships to one another. Each of these sub-signals in turn energizes an antenna element.

The typical feed network divides the one feed signal into the multiplicity of sub-signals through the use of a binary division scheme. Thus, a typical feed network uses a multiplicity of couplers each of which convert an input signal into two output signals. Accordingly, such a coupler may divide a feed signal into first and second intermediate signals. Another such coupler may then divide the first intermediate signal into third and fourth intermediate signals. Likewise, another such coupler may divide the second intermediate signal into fifth and sixth intermediate signals. This process of dividing one signal into two signals continues until a sub-signal for each element in the antenna system is provided.

Design requirements resulting from miniaturization and complication of image element and other multi-element antenna systems necessitate the use of high performance couplers. As an antenna system incorporates more elements in a smaller area the cross-coupling between the elements increases. Thus, couplers used in the feed network must satisfactorily isolate one element from another. Additionally, the power division ratio which a coupler must produce between the coupler's output signals increases as a result of such design requirements. For example, the couplers may be required to provide a 13 dB power ratio between the coupler's outputs. Furthermore, complicated antenna systems require that the couplers accurately deliver the designed power and phase relationships. Thus, the inevitable variations in a coupler's dimensions that occur within reasonable manufacturing tolerances must not substantially affect such relationships.

Although the prior art teaches couplers that could be adapted to many of the high performance requirements mentioned above, such teaching fails fo suggest an entirely satisfactory coupler. Thus, the Wilkinson Power Divider, the Magic TEE (or Unequal Hybrid Ring), the Coupled Line Directional Couplers, and the Uneven Power Split Coupler described in the NASA Technical Memorandum No. 81,870, August 1980, each fail to demonstrate satisfactory performance.

The well known Wilkinson Power Divider represents a junction having three ports. A first port serves as an input, while second and third ports represent the ends of coupler legs and operate as outputs. A resistor connects between the coupler legs at the second and third ports. The Wilkinson Power Divider accomplishes an unequal power division by using legs having different impedances and accomplishes isolation between the outputs through the use of the resistor.

However, the Wilkinson Power Divider causes problems at higher ratios of power division. A miniaturized antenna system using stripline or microstrip construction techniques requires reasonably small conductive strips. Conversely, the conductive strips must be large enough so that variations within achievable manufacturing tolerances do not produce a significant effect. Thus, a 50 ohm line represents an advantageous compromise because it typically uses a 0.040 inch wide conductive strip having a manufacturing tolerance of 0.003 inch. The Wilkinson Power Divider problem occurs because at higher ratios of power division one of the coupler legs must have a very high impedance. For example, such a high ratio power division might require a coupler leg only 0.005 inch wide. Since the typical manufacturing tolerance is 0.003 inch, a designer could expect only a 60% accuracy on the power ratio. Using costly high precision manufacturing techniques, the tolerance could be pushed to 0.001 inch. However, such costly techniques would provide only a 20% accuracy on the power ratio which is still inadequate. Thus, the Wilkinson Power Divider becomes ineffective when small width conductive strips are used.

The well known Magic TEE, or Unequal Hybrid Ring using stripline or microstrip techniques, represents a junction having four ports. A first port serves as the coupler input. A quarter-wavelength, high impedance coupler leg connects the first port to a second port, and a quarter-wavelength, low impedance coupler leg connects the first port to a third port. The second and third ports operate as coupler outputs. Another quarter-wavelength, high impedance leg connects the third port to a fourth port, and a three-quarters-wavelength, low impedance leg completes a ring by connecting the fourth port to the second port. The fourth port terminates into a resistor to provide the isolation function. Thus, the ratio of the impedances between the low and high impedance legs determines the power division ratio.

The Magic TEE also fails to meet design needs at high power division ratios. Since low and high impedance legs determine the power ratio, the Magic TEE suffers from similar problems as the Wilkinson Power Divider. Thus, at high ratio power divisions either the low impedance legs are so large that they force the coupler to use too much space, or the high impedance legs are so small that they cannot be accurately maunfactured.

The well known Coupled Line Directional Couplers suggest another power division technique. The field of a first transmission line couples to a second transmission line when the two lines are placed close enough together for a suitable coupling length, which is typically a quarter-wavelength. Here, the gap between the lines determines the power division ratio. Again, the achievable manufacturing tolerances on a gap between two lines prevents these couplers from being effective at power ratios above 8 dB.

The Uneven Power Split Coupler described in NASA Technical Memorandum No. 81,870 suggests a technique for achieving a manufacturable high ratio power division between the outputs of a coupler. However, it also fails to meet design needs because it does not suggest how to isolate the outputs. Thus, such a coupler would degrade performance of a miniaturized antenna system because cross-coupling between the elements would cause unwanted signals to propagate through the feed network. Since a system relies on complex and highly accurate radiation patterns, the propagation of unwanted signals through the feed network would tend to negate the desired effect.

SUMMARY OF THE INVENTION

A microwave coupler which converts an input signal into two output signals defines the present invention. A predetermined power ratio at an equal-phase relationship characterizes the coupler's two outputs. One integral portion of the coupler splits the input signal into two equal-phase, equal power level, intermediate signals. Another portion attenuates out-of-phase components of the intermediate signals. An additional integral portion converts the two equal-phase intermediate signals into two phase shifted signals. The phase shifted signals exhibit a predetermined phase shift relative to each other which corresponds to the outut signals' power ratio. A quadrature hybrid then superpositions the two phase shifted signals to produce the coupler's outputs.

One object of the present invention concerns providing an isolated coupler. In various applications unwanted signals may be cross-coupled into an output of the coupler. The isolation prevents such signals from propagating to the input of the coupler and to the other coupler output.

Another object relates to providing a physically small coupler. A small coupler can be constructed in stripline or microstrip using only conductive strips having an impedance of approximately 50 ohms or greater. Thus, complex, miniaturized antenna systems having many antenna elements in a small area may advantageously use the present invention.

Still another object concerns producing a manufacturable coupler. A manufacturable coupler can be constructed in stripline or microstrip using only reasonably wide conductive strips. Thus, manufacturing tolerances which allow small variations in a strip's width produce no significant effect because the small variations represent only an insubstantial variance in a reasonably wide strip.

Yet another object requires the achievement of a wide range of power ratios between the coupler's output signals. Accordingly, the present coupler may be utilized to provide output power ratios through a minimum range of 0–13 dB and serves the needs of feed networks which incorporate large power divisions.

A further object of the present invention is to provide a coupler which is simple and inexpensive. Thus, stripline and microstrip techniques, which are well known in the art, may be employed in the manufacture of the present invention.

Other important features of this invention will become apparent from a study of the following specification, claims, and the attached drawings.

BRIEF DESCRIPTION OF THE DRAWINGS

FIG. 3 shows an enlarged first microstrip embodiment of the coupler of the present invention.

FIG. 4 shows a second microstrip embodiment of the coupler of the present invention.

DETAILED DESCRIPTION OF THE INVENTION

Figure 1:
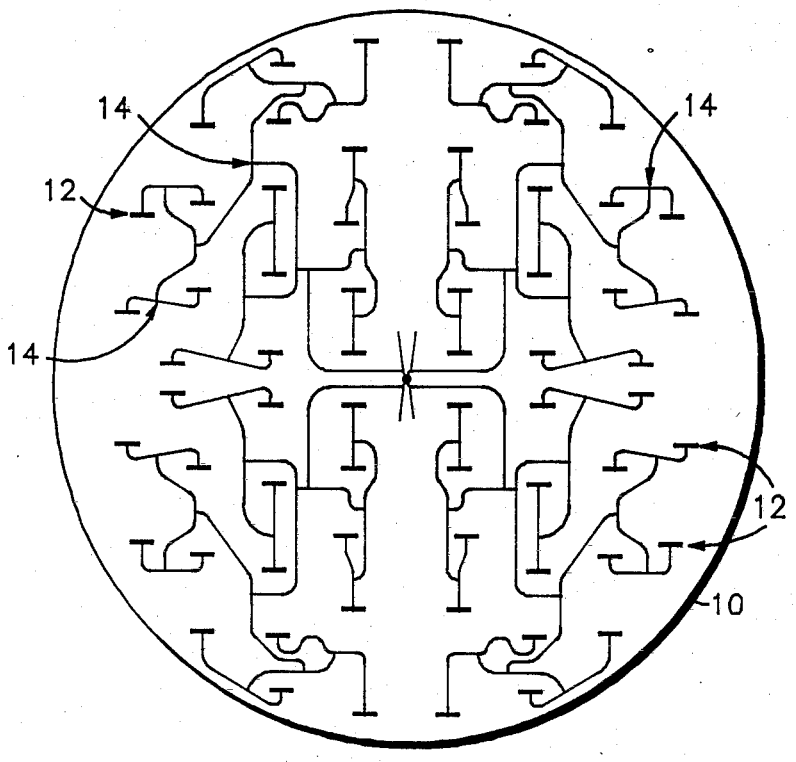
FIG. 1 shows a simplified example of an image element array antenna system that may incorporate the present invention.

FIG. 1 shows an example of a simplified Image Element Array Antenna System 10. Such an antenna system is useful in microwave transmission at frequencies up to at least 15 GHz. In this specific example, antenna system 10 contains 64 antenna elements 12. Each of elements 12 radiates microwave electromagnetic energy so that the result from the entire system is that microwave energy is radiated in a predetermined pattern. Antenna system 10 also contains a multiplicity of couplers 14. Couplers 14 represent three port devices, each of which has one input and two outputs and serves to divide power in a predetermined manner for feeding elements 12.

Figure 2:
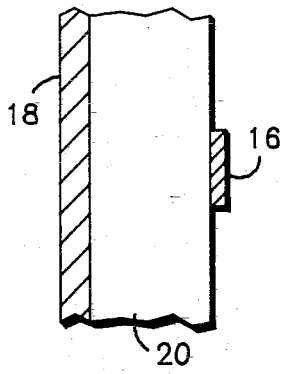
FIG. 2 shows a cross sectional view of a microstrip transmission line.

In this embodiment, antenna system 10, which includes couplers 14, is constructed using well known microstrip or stripline techniques. FIG. 2 shows a cross sectional view of a microstrip transmission line. The fabrication is similar to that of printed circuit boards. A substrate 20 has two parallel surfaces. A conductive strip 16 attaches on one of the parallel surfaces and a conductive ground ground plane 18 attaches to other parallel surface. Copper conductors cladded to a Teflon fiberglass substrate, or any of the many other well known materials may serve as the microstrip. A portion of the copper, or other equivalent material, is photoetched away from the substrate in a predetermined pattern to leave a pattern that forms conductive strips 16. Alternatively, other techniques known by those skilled in the art, such as silk-screening, may be used in forming conductive strips 16.

FIGS. 3 and 4 show two different embodiments of coupler 14 of the present invention. Both embodiments contain similar structure and use equivalent numbers to reference the equivalent structure. An input 22 on one end of a feed strip 24 serves as the input to coupler 14, as shown in both embodiments. In these embodiments feed strip 24 represents an approximately 50 ohm transmission line or strip, that extends between input 22 and first junction 26. The 50 ohms further represents a base impedance to which other transmission lines in coupler 14 have a specific relationship. In these embodiments the length and precise shape of feed strip 24 depends on particular system design requirements.

At first junction 26 feed strip 24 terminates into two parallel division strips **30*a* and 30*b*. Division strips 30*a* and 30*b* each extend for a length equivalent to a quarter-wavelength of an input signal applied at coupler input 22 between first junction 26 and second junctions 32*a* and 32*b*, respectively. Additionally, division strips 30*a* and 30*b* exhibit equal impedances. Accordingly, second junctions 32*a* and 32*b* represent output ports for a simple three port device formed by feed strip 24 and division strips 30*a* and 30*b***.

Division strips 30 split an input signal applied at coupler input 22 into components of intermediate signals which exist at second junctions **32*a* and 32*b*. Since division strips 30*a* and 30*b* are equal in length, the intermediate signal components produced at second junctions 32*a* and 32*b*. respectively are in phase with each other, or in other words exhibit an equal-phase condition. Furthermore, since division strips 30a and 30b are equal in impedance, the intermediate signal components produced at second junctions 32a and 32b**, respectively, occur at the same power level, or in other words exhibit an equal-power level condition.

Division strips 30 outputs only components of the intermediate signals which exist at second junctions 32a and 32b, and not the entire intermediate signals, because other components may also be present. Such "other components" can occur from cross-coupling between elements 12, see FIG. 1, in an antenna system 10 which feeds the cross-coupled signals back into coupler outputs 52a or 52b of coupler 14. Additionally, such "other components" can occur from signal reflections caused by sharp corners and less than perfectly smooth transmission lines within coupler 14 itself.

These "other components" tend to be out-of-phase with the components outputted through division strips 30 at second junctions 32a and 32b due to the random manner in which they occur. To prevent these out-of-phase components from propagating to coupler input 22 and the other of coupler outputs 52, a resistor 34 connected between output ports 32a and 32b attenuates the out-of-phase components. These two embodiments each use a 141 ohm chip-resistor to effectively attenuate the out-of-phase components.

However, this invention also emcompasses other attenuating schemes, such as a film resistance between division strips 30a and 30b and between first junction 26 and second junctions 32a and 32b. Additionally, this invention contemplates the use of other signal splitting structure to produce the equal-power and equal-phase signals at second junctions 32a and 32b. For example, a hybrid ring represents one such alternate signal splitting structure.

Strips 36a and 36b together make phase shifter 36. Strip 36a extends for a predetermined length in a pattern that forms the arc of a circle from second junction 32a to third junction 38a. Likewise, strip 36b extends for a predetermined length in a similar circular pattern from second junction 32b to third junction 38b.

Phase shifter 36 inputs the intermediate signals at second junctions 32a and 32b and transforms them into phase shifted signals at third junctions 38a and 38b, respectively. In these embodiments, each phase shifter strip 36 is a transmission line with an impedance of approximately 70 ohms, or 1.414 times the base impedance. Since the equal-phase components of the intermediate signals at second junctions 32a and 32b exhibit an equal-power level, and since each phase shifter strip 36 exhibits the same impedance as the other phase shifter strip 36, the power levels of the phase shifted signals at third junctions 38a and 38b are also equal.

The impedance for each of division strips 30, described above, matches the impedance of the phase shifter strips 36 to the impedance of feed strip 24. Thus an impedance of approximately 83.7 ohms, or 1.67 times the base impedance, for each of division strips 30 effectively matches the impedance of the 70 ohm phase shifter strips 36 to the 50 ohm feed strip 24.

Phase shifter 36 accomplishes a phase shifting function through the relative lengths of phase shifter strips 36a and 36b. The length of a phase shifter strip 36 is measured along an arc between a second junction 32 and a third junction 38 of an imaginary circle (not shown) located at the center of a phase shifter strip 36. The precise determination of these lengths is discussed later. The FIG. 3 embodiment shows phase shifter strip 36a as being longer than phase shifter strip 36b. Accordingly, for the FIG. 3 embodiment the phase shifted signal at third junction 38a and the phase shifted signal at third junction 38b do not exhibit an equal-phase condition. Rather, the difference between the length of phase shifter strip 36b and the length of phase shifter strip 36a causes the phase shifted signals to demonstrate the predetermined phase shift relative to each other.

On the other hand, the FIG. 4 embodiment shows that the length of phase shifter strip 36a may equal that of phase shifter strip 36b. Thus, in the FIG. 4 embodiment phase shifter 36 produces no relative phase shift between the phase shifted signals at third junctions 38a and 38b. And, in the FIG. 4 embodiment the phase shifted signals exhibit an equal-phase condition.

The phase shifted signals at third junctions 38a and 38b enter a quadrature hybrid 41. Quadrature hybrid 41 combines, or superpositions, these phase shifted signals to produce equal-phase signals at a predetermined power ratio. The equal-phase signals exit quadrature hybrid at fourth junctions 44a and 44b. Thus, quadrature hybrid 41 represents a four port device. It includes: (1) a first quarter-wavelength low impedance strip 40a conecting third junction 38a to fourth junction 44a, (2) a first quarter-wavelength high impedance strip 42b connecting fourth junction 44a to fourth junction 44b, (3) a second quarter-wavelength low impedance strip 40b connecting fourth junction 44b to third junction 38b, and (4) a second quarter-wavelength high impedance strip 42a connecting third junction 38b to third junction 38a.

In these embodiments each of quarter-wavelength strips 40a, 42b, 40b, 42a form a quarter-circle arc so that the resulting interconnection of the strips circumscribes a full circle. The impedance exhibited by high impedance strips 42a and 42b is approximately 1.414 times the impedance exhibited by low impedance strips 40a and 40b. In these specific embodiments approximately 70.7 ohms impedance characterizes high impedance strips 42a and 42b while approximately 50 ohms impedance characterizes low impedance strips 40a and 40b.

Transformers 46a and 46b attach to quadrature hybrid 41 at fourth junctions 44a and 44b respectively. An approximately 59.5 ohm, quarter-wavelength strip serves as each transformer. Transformers 46a and 46b match the impedance of quadrature hybrid 41, which in these embodiments approximates 70 ohms, to the impedance of output strips 50a and 50b.

At fifth junctions 48a and 48b, transformers 46a and 46b attach to output strips 50a and 50b, respectively. Fifth junctions 48a and 48b represent one end of output strips 50a and 50b, respectively. The other ends of output strips 50a and 50b are represented by coupler outputs 52a and 52b, respectively. In these embodiments each of output strips 50 exhibits approximately 50 ohms impedance. The overall system design determines their length.

Coupler 14 presents the equal-phase, predetermined power ratio, isolated output signals at coupler outputs 52a and 52b. It is the relative phase shift produced by phase shifter strips 36a and 36b, mentioned above, that determines the power ratio between the signals output from coupler 14 at coupler outputs 52a and 52b. Thus, the difference in length between phase shifter strip 36b and phase shifter strip 36a corresponds to the desired output power ratio as follows:

$$36a - 36b = \frac{\lambda}{4} - \frac{\lambda}{\pi} \arctan\left(\sqrt{\frac{52b}{52a}}\right),$$

where:

$\lambda$=the wavelength of the signal accommodated by the coupler,

36b=the length of the center of phase shifter strip 36b,

36a=the length of the center of phase shifter strip 36a,

52b=the percentage of input signal power which appears at output 52b, and

52a=the percentage of input signal power which appears at output 52a.

Although the foregoing has described specific embodiments of the present invention, those skilled in the art will recognize that the invention also encompasses many other embodiments. For example, the precise impedances mentioned above may increase or decrease in a manner known to those skilled in the art depending on available materials and manufacturing techniques. Further, other phase shifting techniques could be employed, such as various four port devices with the ports spaced apart by distances other than integral multiples of quarter wavelengths. Transformers, such as transformers 46a and 46b, may be added or removed as necessary to match impedances or implement compensation schemes between the various transmission lines included in coupler 14. Although the foregoing describes coupler 14 in terms of microstrip and stripline traces having certain patterns, those skilled in the art will recognize that other patterns and forms of microwave transmission also equate to the present invention. These examples and other modifications obvious to those skilled in the art are intended to be included in the scope of this invention.

I claim:

1. A microwave coupler for converting an input signal into first and second equal-phase output signals having a predetermined power ratio between the output signals, said coupler comprising:

means for splitting the input signal into a first intermediate signal at a first port thereof and a second intermediate signal at a second port thereof wherein each of the first and second intermediate signals exhibits a phase and a power level equal to a phase and a power level, respectively, exhibited by the other of the first and second intermediate signals;

means for attenuating out-of-phase components of the first and second intermediate signals, said attenuating means having first and second ports coupled to the first and second ports, respectively, of said splitting means;

a microstrip phase shifter having a first conductive strip with first and second ports and a second conductive strip with third and fourth ports, the first and third ports of said phase shifter being coupled to the first and second ports, respectively, of said splitting means, and the first and second strips of said phase shifter having a difference in length which approximately equals:

$\lambda/4-(\lambda/\pi)\arctan(\sqrt{P_r})$, wherein $\lambda$ represents the wavelength of the input signal, and $P_r$ represents the predetermined power ratio between the output signals; and a quadrature hybrid having a first port coupled to the second port of said phase shifter, a second port coupled to the fourth port of said phase shifter, a third port for producing the first output signal, and a fourth port for producing the second output signal.

2. A coupler as claimed in claim 1 wherein said splitting means comprises a three port device.

3. A coupler as claimed in claim 1 wherein:

said attenuating means comprises a resistor coupled between the first and second output ports of said splitting means.

4. A coupler as claimed in claim 1 wherein said splitting means and said quadrature hybrid each comprise an integral section of a substrate having a first and a second parallel surface in each section, said first parallel surface in each section having a plurality of conductive strips attached thereon and said second parallel surface having a conductive ground plane attached thereon so that said conductive strips in cooperation with said ground plane form said splitting means and quadrature hybrid.

5. A coupler as claimed in claim 4 wherein each of the plurality of conductive strips comprises a transmission line having an impedance substantially between 45 ohms and 90 ohms.

6. A three port microwave coupler for receiving an input signal and for providing first and second output signals wherein the first output signal is in phase with the second output signal and a predetermined ratio exists between the power level of the first output signal and power level of the second output signal, said coupler comprising:

a substrate having first and second parallel surfaces, said second parallel surface having a conductive ground plane attached thereon;

a feed strip attached to said substate first surface, said feed strip adapted for receiving the input microwave signal;

a first and a second division strip each attached to said substrate first surface and to said feed strip;

a chip-resistor attached to said substrate first surface and coupled between said first and second division strips;

a first and a second phase shifter strip each attached to said substrate first surface, said first and second phase shifter strips attached to said first and second division strips, respectively, and said first and second phase shifter strips having a difference in length which approximately equals:

$\lambda/4-(\lambda/\pi)\arctan(\sqrt{P_r})$, wherein $\lambda$ represents the wavelength of the input signal, and $P_r$ represents the predetermined ratio between the power level of the first output signal and the power level of the second output signal;

a quadrature hybrid having first and second high impedance strips and having first and second low impedance strips, said quadrature hybrid attached to said substrate first surface and to said phase shifter strips;

a first and a second transformer strip each attached to said substrate first surface and to said quadrature hybrid; and a first and a second output strip each attached to said substrate first surface, and said first and second output strips attached to said first and second transformer strips, respectively, said output strips for providing the output signal.

7. A microwave coupler as claimed in claim 6 wherein:

said feed strip exhibits a base impedance;

said first and second division strips each exhibit an impedance substantially 1.67 times the base impedance;

said chip-resistor has a resistance substantially 2.82 times the base impedance;

said first and second phase shifter strips each exhibit an impedance substantially 1.41 times the base impedance;

said quadrature hybrid high impedance strips each exhibit an impedance substantially 1.41 times the base impedance, and said quadrature hybrid low impedance strips each exhibit an impedance substantially equal to the base impedance;

said first and a second transformer strips each exhibit an impedance substantially 1.19 times the base impedance; and said first and a second output strip each substantially exhibit the base impedance.

* * * * *